US006082559A

United States Patent [19]

Levsen

[11] Patent Number: 6,082,559

[45] Date of Patent: Jul. 4, 2000

[54] KNIFE HOLDER

[75] Inventor: Clark A. Levsen, Shawnee, Kans.

[73] Assignee: Hantover, Inc., Kansas City, Mo.

[21] Appl. No.: 09/264,267

[22] Filed: Mar. 8, 1999

[51] Int. Cl.[7] ..... A47F 7/00

[52] U.S. Cl. ..... 211/70.7; 30/329; 248/37.3

[58] Field of Search ..... 211/70.6, 70.7, 211/69, 69.1, 60.1, 85, 125, 181.1; 248/37.3, 37.6; D7/637, 213; 30/142, 286, 296.1, 329

[56] References Cited

U.S. PATENT DOCUMENTS

| | | | |
|---|---|---|---|
| D. 110,294 | 6/1938 | Speik | D7/613 |
| 1,346,909 | 7/1920 | Onufryk | 30/296.1 |
| 1,861,683 | 6/1932 | Branch | 30/296.1 |
| 4,318,478 | 3/1982 | De Winter | 211/60.1 |
| 4,423,552 | 1/1984 | Bourgein et al. | 30/296.1 |
| 4,575,939 | 3/1986 | Buchtel | 211/60.1 |
| 5,738,228 | 4/1998 | Bittinger | 211/69.1 |
| 5,947,276 | 9/1999 | Hsu | 211/69.1 |

*Primary Examiner*—Daniel P. Stodola
*Assistant Examiner*—Jennifer E. Novosad
*Attorney, Agent, or Firm*—Hovey, Williams, Timmons & Collins

[57] ABSTRACT

A utensil holder generally includes a case and a utensil-retaining rod assembly. The case presents a utensil-receiving opening, and the rod assembly includes a plurality of elongated, flexible rods. The rods are confined within the utensil-receiving opening in a manner that permits limited flexing movement of the rods, whereby a utensil inserted into the opening causes elastic displacement of adjacent ones of the rods to define a space that at least substantially collapses when the utensil is removed from the opening. This permits the utensil to be supported virtually anywhere within the opening. In addition, the rods are sufficiently packed within the opening to support the utensil in the desired orientation. Moreover, the rods are restricted against lengthwise shifting relative to one another, which permits the rod assembly to be unitarily disassembled from the case, if desired.

17 Claims, 2 Drawing Sheets

KNIFE HOLDER

BACKGROUND OF THE INVENTION

1. Field of the Invention

The present invention relates generally to devices for holding knives and/or other utensils. More particularly, the present invention concerns a utensil holder having a utensil-receiving opening and structure within the opening that permits various utensils to be inserted and supported in virtually infinitely variable locations within the opening. That is to say, the inventive utensil holder has means for supporting a utensil, wherein the utensil supporting means is essentially non-sensitive to the shape and size of the utensil and to the location of utensil when it is supported thereby.

2. Discussion of Prior Art

Those ordinarily skilled in the art will appreciate that utensil holders, such as knife blocks, are commonly used in industry and in many households. However, there are many problems associated with conventional knife block designs. For example, a knife block is traditionally provided with a number of open slots, each of which is specifically designed for receiving a certain sized and shaped utensil. That is to say, each slot is designed to receive a specific utensil, and it is therefore unlikely that the slot can receive a utensil other than that intended to correspond with the slot. This, of course, presents the problem of matching the utensil set with the utensil block. A utensil not specifically corresponding with the slots in the holder will likely have to be stored separate from the block. Another problem with conventional utensil holders involves sanitation. Particularly, the narrow slots for receiving the utensils are nearly impossible to clean. This is particularly problematic when the holder is used in industrial applications (e.g., restaurants), wherein it would be beneficial to provide a support for the utensil during use. Yet another problem with the utensil-receiving slots of conventional holders involves the difficulty of inserting the utensils into the slots. Often times the slot for a knife is relatively narrow and the user may be required to handle the knife blade to help guide the blade into the slot.

OBJECTS AND SUMMARY OF THE INVENTION

Responsive to these and other problems, an important object of the present invention is to provide an improved utensil holder. Another important object of the present invention is to provide a utensil holder that is particularly well suited for supporting a plurality of knives. It is also an important object of the present invention to provide a utensil holder that is not limited to use with a specific utensil or set of utensils. Yet another object of the present invention is to provide a utensil holder that can be easily and effortlessly cleaned so as to reduce the risk of microorganism growth in the holder. Along this line, it is an important object of the present invention to provide a utensil holder that is particularly effective in supporting utensils during use, without requiring cleaning of the utensil before placed in the holder. An additional important object of the present invention is to provide a utensil holder that simplifies placement of the utensils in the holder. That is, it is an important object of the present invention to provide a utensil holder that permits the user to virtually effortlessly and mindlessly place utensils in the holder.

In accordance with these and other objects evident from the following description of the preferred embodiment, the present invention concerns a utensil holder comprising a case having a utensil-receiving opening. The holder further includes a utensil-retaining rod assembly having a plurality of rods that are confined within the utensil-receiving opening in a manner that permits limited flexing movement of the rods, whereby a utensil inserted into the opening causes displacement of the adjacent rods to define a space that at least substantially collapses when the utensil is removed. However, the rods are confined sufficiently tightly within the utensil-receiving opening that the utensil is retained in the desired orientation by the assembly. Moreover, the rods are prevented from lengthwise shifting relative to one another. With the rod assembly being configured to prevent the relative lengthwise shifting of the rods, the assembly may be unitarily removed from the utensil-receiving opening.

In this respect, it will be appreciated that the holder is essentially nonsensitive to the types of utensils being inserted into the opening, and to the location of the utensils when supported within the opening. That is to say, the rod assembly permits various utensils to be supported within the opening in virtually infinitely variable locations. In addition, the inventive construction permits the rod assembly to be configured for easy removal from and reinsertion into the case, which facilitates cleaning of the holder.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 3:
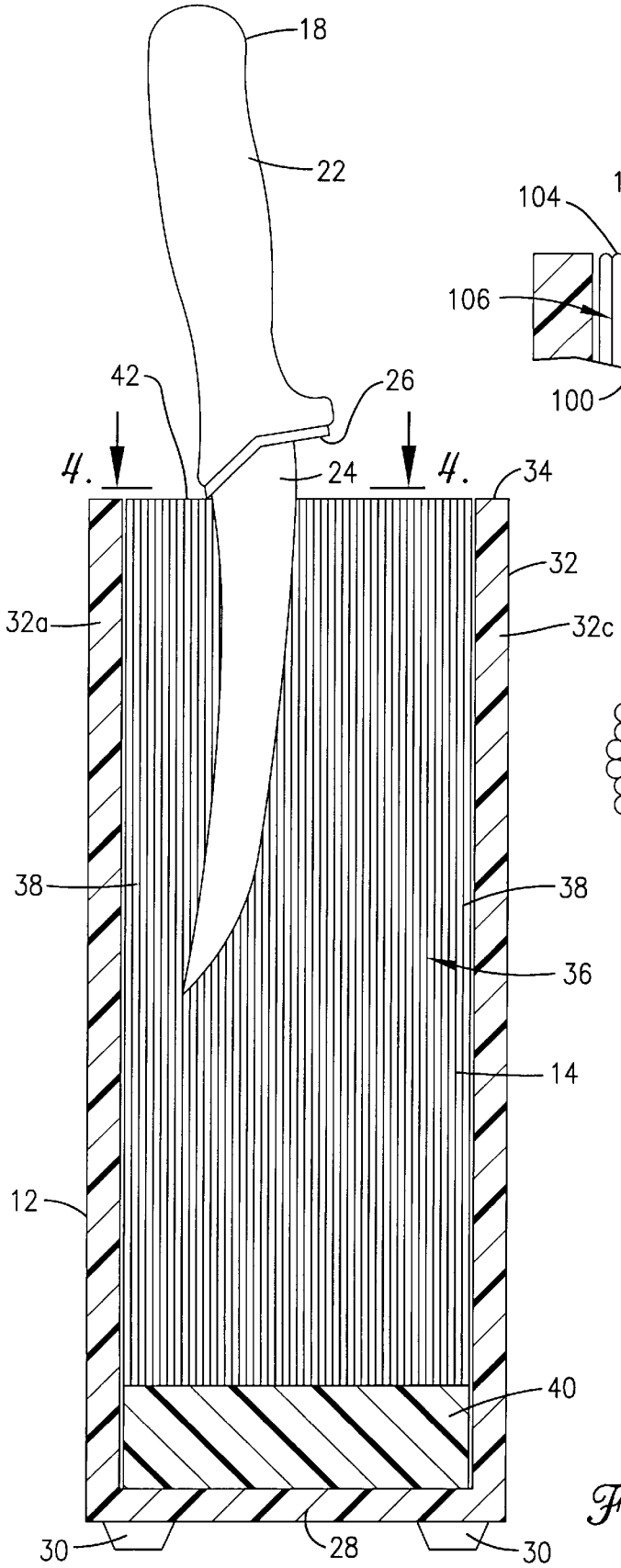
FIG. 3 is a vertical cross-sectional view taken along line 3—3 of FIG. 2, particularly illustrating one of the knives extending along the length of the rods, with the knife flange abutting the top ends of the rods.
Figure 5:
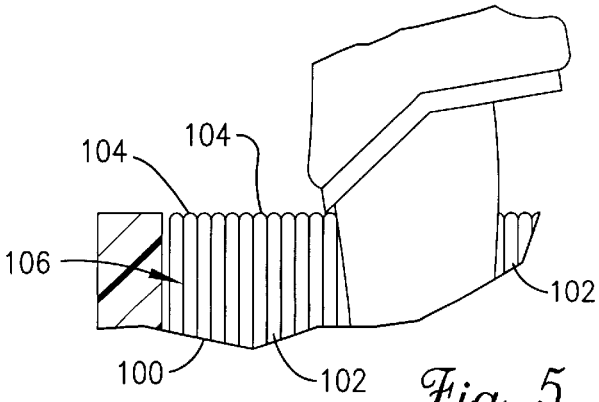
Figure 4:
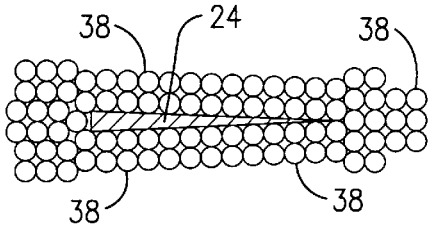

FIG. 4 is a horizontal cross-sectional view taken along line 4—4 of FIG. 3, particularly illustrating the elastic flexing displacement of adjacent ones of the rods when the knife is inserted into the rod assembly; and FIG. 5 is an enlarged vertical cross-sectional view of an alternative embodiment of the present invention, wherein the tops of the rods are rounded to facilitate insertion of the knife into the rod assembly.

DETAILED DESCRIPTION OF THE PREFERRED EMBODIMENTS

Figure 1:
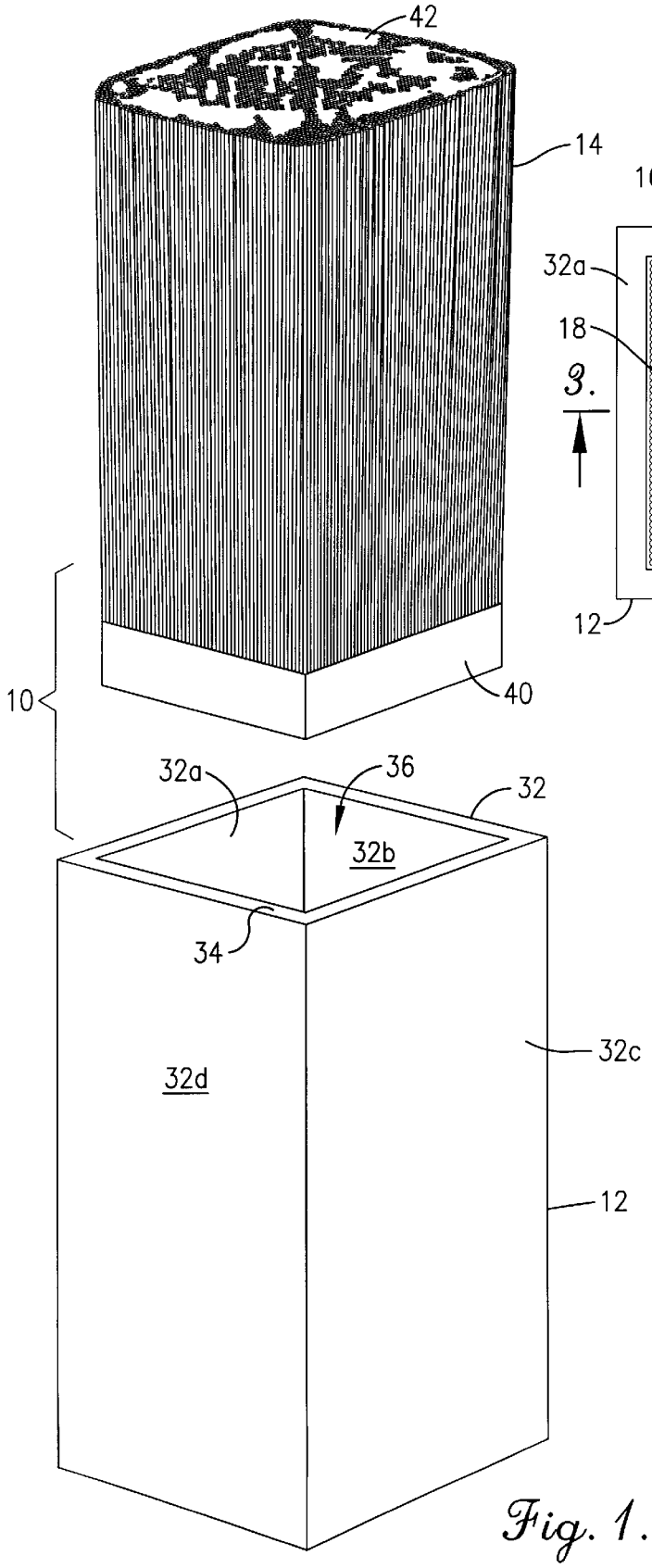
FIG. 1 is an exploded perspective view of a utensil holder constructed in accordance with the principles of the present invention, illustrating the utensil-retaining rod assembly being unitarily removed from the utensil-receiving opening of the case.
Figure 2:
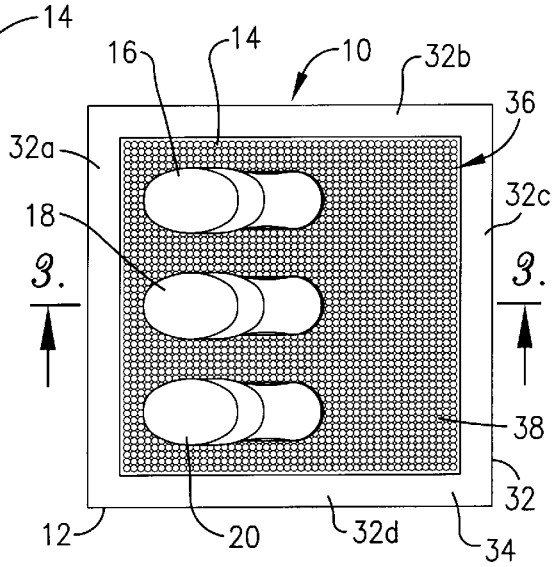
FIG. 2 is a top plan view of the knife holder, particularly illustrating a set of knives being supported by the holder.

Turning initially to FIG. 1, the utensil holder 10 selected for illustration generally includes a case 12 and a utensil-retaining rod assembly 14. The holder 10 is designed to support a plurality of utensils, such as the knives 16, 18, 20 shown in FIG. 2. As particularly illustrated with respect to the knife 18 (see FIG. 3), the knife 18 customarily includes a handle 22 and a blade 24 projecting from the handle 22. In the usual manner, the blade 24 is significantly narrower than the handle 22 such that a flange 26 is defined generally at the junction of the blade 24 and handle 22. Although the holder 10 is shown supporting the knives, it will be appreciated that various other utensils (e.g., a sharpening rod, a potato peeler, scissors, other types of knives, etc.) may be placed in the holder 10.

The illustrated case 12 is generally rectangular in shape and presents an open top, although various other case designs may be used. In particular, the illustrated case 12 includes a substantially flat, square-shaped floor 28 that is supported in a horizontal orientation by four feet 30 (only two of the feet being shown in the drawing figures). The feet 30 are preferably formed of nonslip material, such as rubber, although other materials may be used. Wall structure 32 projects upwardly from the floor 28, with the illustrated structure 32 comprising four similar flat panels 32*a,* 32*b,* 32*c,* 32*d.* In this respect, the wall structure 32 presents a square cross-sectional shape. The panels 32*a,* 32*b,* 32*c,* 32*d* are preferably equal in length to cooperatively define a substantially flat uppermost edge 34 of the case 12. The floor 28 and wall panels 32*a,* 32*b,* 32*c,* 32*d* are preferably formed of a synthetic resin material, such as acrylic, and are bonded to one another, although it is entirely within the ambit of the present invention to integrally form the case (e.g., by injection molding) and/or to form the case of various other materials (e.g., wood, stainless steel, etc.). It is also noted that the configuration of the case 12 may be varied, if desired. For example, the case may alternatively have a circular or triangular cross-sectional shape.

The floor 28 and wall structure 32 cooperatively define a utensil-receiving opening 36 that extends generally from the floor 28 to the top edge 34. The illustrated floor 28 and wall panels 32*a*–32*d* are solid such that the opening 36 is capable of containing fluid therein, for purposes will subsequently be described. However, the principles of the present invention are equally applicable to a case that is not configured to contain fluid within the opening 36. For example, the present invention contemplates the use of a perforated floor and/or wall panels. It will be appreciated that the opening 36 has a square cross-sectional shape similar to the wall structure 32 and that this shape may likewise vary, if desired.

In the illustrated embodiment, the rod assembly 14 and opening 36 are cooperatively defined so that the former is completely received within the latter. The rod assembly 14 particularly comprises a plurality of elongated, flexible rods 38 that are equal in length and prevented from lengthwise shifting relative to one another. Preferably, the rods 38 project from a common base 40 that conforms generally to the shape of the utensil-receiving opening 36. In this respect, the base 40 has a square cross-sectional shape in the illustrated embodiment. Except for the base 40, the illustrated rods 38 are otherwise detached from one another and each rod is therefore capable of bending along its respective axis.

It is noted that each of the illustrated rods 38 is cylindrical in shape (see FIG. 4) and presents a generally flat upper end. The upper ends of the rods 38 cooperatively define a substantially flat utensil entry face 42 that is generally flush with the upper edge 34 of the case 12 in the illustrated embodiment (see FIG. 3). The upper edge 34 and entry face 42 are parallel to the floor 28, although the edge 34 and face 42 may be disposed along a plane that is oblique relative to the floor if desired. It is also possible to configure the holder 10 so that the wall structure projects beyond the upper ends of the rods, with the utensil-receiving opening consequently extending beyond the rod assembly. It would therefore be possible with this arrangement to insert a utensil into the opening without it being supported by the rod assembly. However, it shall be assumed with respect to this construction that the utensil may be inserted sufficiently into the opening to be supported by the rod assembly. The construction of the rods 38 may be also be varied. For example, the principles of the present invention are equally applicable to rods having various other cross-sectional shapes (e.g., oval, triangular, etc.). In addition, it is not necessary that all of the rods 38 be of the same shape and size.

The size of the opening 36 and the number of rods 38 included in the assembly 14 are cooperatively designed so that the rods 38 are confined within the opening in a manner that permits limited flexing movement of the rods 38. Particularly, the rods 38 are displaceable when the blade 24 is inserted into the opening 36, as shown in FIG. 4, but still provide enough support to the blade 24 to retain the knife 18 in the illustrated orientation. It may consequently be said that the rods 38 are loosely held within the opening 36 yet are sufficiently packed therein to provide support to the utensils. One suitable arrangement consists of a four inch square utensil-receiving opening and a rod assembly having approximately 635 cylindrical 0.1875 inch diameter rods. It is also noted that the preferred rods 38 are sufficiently flexible to be elastically displaced when a utensil is inserted into the opening 36. This will permit the utensil to flex adjacent rods 38 away from one another to define a space therebetween, with the elasticity of the rods causing the space to collapse when the utensil is removed.

The rods 38 are preferably formed of a synthetic resin material, such as polyvinyl chloride, although other suitable materials may be used. The preferred base 40 is formed cooperatively by the lower ends of the rods 38 and a synthetic resin filler interspersed among the rods, with the rods and filler being bonded to one another. One suitable arrangement involves rods formed of polyvinyl chloride (e.g., 0.1875 inch PVC welding rods) and filler comprising cold-poured acrylic. With respect to this arrangement, forming of the block 40 may involve placing the lower ends of the rods 38 into a suitable press mold that is manipulated into the desired shape and size of the block, and then pouring the acrylic filler into the mold. In any case, the preferred block 40 will consequently become a solid mass that serves to interconnect the rods 38 and thereby prevent relative lengthwise shifting of the rods 38. Thus, the illustrated utensil-retaining rod assembly 14 may be unitarily disassembled and reassembled with the case 12.

In use, the utensil-retaining rod assembly 14 is placed within the case 12 and utensils may thereafter be supported in virtually any location within the utensil-receiving opening 36. In addition, virtually any traditional elongated utensil may be inserted lengthwise into the opening 36. With particular respect to the knife 18, the blade 24 is pierced through the entry face 42 of the rod assembly 14 between adjacent rods and then slid along the length of the adjacent rods 38. This will cause elastic displacement of the adjacent rods 38, as shown in FIG. 4. Insertion of the blade 24 preferably continues until the flange 26 engages the upper ends of the rods 38, whereby further downward movement of the knife 18 is restricted. As noted above, the rods 38 are sufficiently confined within the opening 36 to retain the knife 18 in the illustrated upright orientation. Moreover, once the knife 18 is removed, the space created by the blade 24 collapses as the rods 38 elastically return to their original position. Because the rods 38 span the utensil-receiving opening 36, the knife 18 may be inserted virtually anywhere between the wall panels 32*a*–32*d.* In addition, any utensil that does not cause excessive displacement or wedging of the rods 38 may be supported within the opening.

Again, the illustrated utensil-retaining rod assembly 14 may be unitarily removed from the case 12. It is particularly noted that the base 40 has a cross-sectional size that is slightly smaller than the opening 36, such that the assembly 14 may be easily slid through the top of the case 12. The assembly 14 may then be cleaned as desired, with flexing of the rods 38 facilitating cleaning of the interstices defined therebetween With the assembly 14 removed, cleaning of the interior of the casing 12 is also facilitated. If desired, the container 12 may be filled with a suitable disinfecting fluid when the rod assembly 14 is received within the opening 36 so as to disinfect the knife blade 24 each time it is supported in the holder 10.

As previously noted, it is within the ambit of the present invention to vary the construction of the utensil holder. One such variation is shown in FIG. 5, wherein the utensil-retaining rod assembly 100 includes a plurality of rods 102 similar to the rod assembly 14 shown in FIGS. 1–4. However, the upper ends 104 of the rods 102 are rounded, which is believed to facilitate insertion of the utensil into the utensil receiving opening 106.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A utensil holder comprising:

a case presenting a utensil-receiving opening; and a utensil-retaining rod assembly including a plurality of elongated, flexible rods, said rods being confined within the utensil-receiving opening in a manner that permits limited flexing movement of the rods, such that a utensil inserted into the opening is supported by the rod assembly and causes separation of adjacent ones of the rods to define a space that at least substantially collapses when the utensil is removed from the opening, said rods being restricted against lengthwise shifting relative to one another, said utensil-retaining rod assembly being configured to prevent relative lengthwise shifting of the rods so that the assembly may be unitarily removed from the utensil-receiving opening, said utensil-retaining rod assembly including a base, said rods being fixed relative to the base and projecting therefrom, said base being located adjacent a common end of the rods, with the rods being otherwise detached from one another, said rods cooperatively defining an endmost entry face opposite from the base, said entry face spanning the utensil-receiving opening so that the utensil pierces through the entry face and then passes along the length of the rods.

2. A utensil holder comprising:

a case presenting a utensil-receiving opening; and a utensil-retaining rod assembly including a plurality of elongated, flexible rods, said rods being confined within the utensil-receiving opening in a manner that permits limited flexing movement of the rods, such that a utensil inserted into the opening is supported by the rod assembly and causes separation of adjacent ones of the rods to define a space that at least substantially collapses when the utensil is removed from the opening, said rods being restricted against lengthwise shifting relative to one another, said utensil-retaining rod assembly being configured to prevent relative lengthwise shifting of the rods so that the assembly may be unitarily removed from the utensil-receiving opening, said utensil-retaining rod assembly including a base, said rods being fixed relative to the base and projecting therefrom, said rods having common detached ends that cooperatively define an endmost entry face spanning the utensil-receiving opening so that the utensil pierces through the entry face and then passes along the length of the rods.

3. A utensil holder as claimed in claim 2, said case being formed of a synthetic resin.

4. A utensil holder as claimed in claim 2, said case including a floor and wall structure projecting generally upwardly from the floor, with the utensil-receiving opening being cooperatively defined by the floor and wall structure.

5. A utensil holder as claimed in claim 4, said floor and wall structure being solid so as to permit fluid containment within the utensil-receiving opening.

6. A utensil holder as claimed in claim 4, said wall structure terminating at a substantially planer uppermost edge, said rods extending lengthwise along the wall structure, said entry face being generally flush with the uppermost edge of the wall structure.

7. A utensil holder as claimed in claim 6, said floor being substantially flat, said case including a plurality of feet configured to support the floor in a substantially horizontal orientation.

8. A utensil holder as claimed in claim 7, said uppermost edge of the wall structure being substantially parallel to the floor, and said rods being substantially equal in length.

9. A utensil holder as claimed in claim 2, said utensil-receiving opening having a generally square cross-sectional shape.

10. A utensil holder as claimed in claim 2, said base presenting a cross-sectional shape that is similar to but relatively smaller than that of the utensil-receiving opening.

11. A utensil holder as claimed in claim 2, said base being located adjacent a common end of the rods, with the rods being otherwise detached from one another.

12. A utensil holder as claimed in claim 2, said rods and said base being formed of a synthetic resin.

13. A utensil holder as claimed in claim 12, said base being formed cooperatively by the rods and a synthetic resin filler interspersed among the rods, with the rods and filler being bonded to one another.

14. A utensil holder as claimed in claim 13, said synthetic resin filler being acrylic.

15. A utensil holder as claimed in claim 2, said ends of the rods being rounded.

16. A utensil holder as claimed in claim 2, said rods being substantially equal in cross-sectional shape and size.

17. A utensil holder as claimed in claim 16, said rods being cylindrical.

* * * * *

US006082559C1

(12) EX PARTE REEXAMINATION CERTIFICATE (9706th)

United States Patent
Levsen

(10) Number: US 6,082,559 C1
(45) Certificate Issued: Jun. 13, 2013

(54) KNIFE HOLDER

(75) Inventor: Clark A. Levsen, Shawnee, KS (US)

(73) Assignee: Hantover, Inc., Kansas City, MO (US)

Reexamination Request:
No. 90/012,605, Sep. 14, 2012

Reexamination Certificate for:

| | |
|---|---|
| Patent No.: | **6,082,559** |
| Issued: | **Jul. 4, 2000** |
| Appl. No.: | **09/264,267** |
| Filed: | **Mar. 8, 1999** |

(51) Int. Cl.
*A47G 21/14* (2006.01)
*A47F 7/00* (2006.01)

(52) U.S. Cl.
USPC ..... 211/70.7; 248/37.3; 30/329

(58) Field of Classification Search
None
See application file for complete search history.

(56) References Cited

To view the complete listing of prior art documents cited during the proceeding for Reexamination Control Number 90/012,605, please refer to the USPTO's public Patent Application Information Retrieval (PAIR) system under the Display References tab.

*Primary Examiner* — William Kelleher

(57) ABSTRACT

A utensil holder generally includes a case and a utensil-retaining rod assembly. The case presents a utensil-receiving opening, and the rod assembly includes a plurality of elongated, flexible rods. The rods are confined within the utensil-receiving opening in a manner that permits limited flexing movement of the rods, whereby a utensil inserted into the opening causes elastic displacement of adjacent ones of the rods to define a space that at least substantially collapses when the utensil is removed from the opening. This permits the utensil to be supported virtually anywhere within the opening. In addition, the rods are sufficiently packed within the opening to support the utensil in the desired orientation. Moreover, the rods are restricted against lengthwise shifting relative to one another, which permits the rod assembly to be unitarily disassembled from the case, if desired.

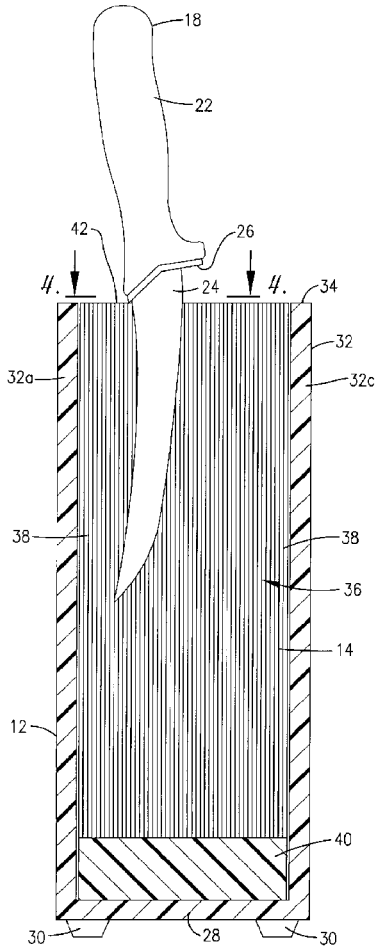

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 13 is cancelled.

Claims 1, 2, 12 and 14 are determined to be patentable as amended.

Claims 3-11 and 15-17, dependent on an amended claim, are determined to be patentable.

New claims 18-25 are added and determined to be patentable.

1. A utensil holder comprising:

a case presenting a utensil-receiving opening; and a utensil-retaining rod assembly including a plurality of elongated, flexible rods, said rods being confined within the utensil-receiving opening in a manner that permits limited flexing movement of the rods, such that a utensil inserted into the opening is supported by the rod assembly and causes separation of adjacent ones of the rods to define a space that at least substantially collapses when the utensil is removed from the opening, said rods being restricted against lengthwise shifting relative to one another, said utensil-retaining rod assembly being configured to prevent relative lengthwise shifting of the rods so that the assembly may be unitarily removed from the utensil-receiving opening, said utensil-retaining rod assembly including a base, said rods being fixed relative to the base and projecting therefrom, said base being located adjacent a common end of the rods, with the rods being otherwise detached from one another,

*said base being formed cooperatively by the rods and a synthetic resin filler interspersed among the rods, with the rods and filler being bonded to one another,* said rods cooperatively defining an endmost entry face opposite from the base, said entry face spanning the utensil-receiving opening so that the utensil pierces through the entry face and then passes along the length of the rods.

2. A utensil holder comprising:

a case presenting a utensil-receiving opening; and a utensil-retaining rod assembly including a plurality of elongated, flexible rods, said rods being confined within the utensil-receiving opening in a manner that permits limited flexing movement of the rods, such that a utensil inserted into the opening is supported by the rod assembly and causes separation of adjacent ones of the rods to define a space that at least substantially collapses when the utensil is removed from the opening, said rods being restricted against lengthwise shifting relative to one another, said utensil-retaining rod assembly being configured to prevent relative lengthwise shifting of the rods so that the assembly may be unitarily removed from the utensil-receiving opening, said utensil-retaining rod assembly including a base, said rods being fixed relative to the base and projecting therefrom, *said base being formed cooperatively by the rods and a synthetic resin filler interspersed among the rods, with the rods and filler being bonded to one another,* said rods having common detached ends that cooperatively define an endmost entry face spanning the utensil-receiving opening so that the utensil pierces through the entry face and then passes along the length of the rods.

12. A utensil holder as claimed in claim 2, said rods [and said base] being formed of a synthetic resin.

14. A utensil holder as claimed in claim [13,]*2*, said synthetic resin filler being acrylic.

*18. A utensil holder as claimed in claim 2, said case being formed of wood.*

*19. A utensil holder as claimed in claim 2, said case being formed of stainless steel.*

*20. A utensil holder as claimed in claim 2, said case having a circular cross-sectional shape.*

*21. A utensil holder as claimed in claim 2, said case having a rectangular shape.*

*22. A utensil holder as claimed in claim 4, said floor being perforated.*

*23. A utensil holder as claimed in claim 4, said wall structure being perforated.*

*24. A utensil holder as claimed in claim 16, said rods being oval in cross-sectional shape.*

*25. A utensil holder as claimed in claim 16, said rods being formed of polyvinyl chloride.*

* * * * *